US008821997B2

(12) United States Patent
Romano, Jr. et al.

(10) Patent No.: US 8,821,997 B2
(45) **Date of Patent: *Sep. 2, 2014**

(54) RECORDING MEDIUM FOR INKJET PRINTING

(75) Inventors: Charles E. Romano, Jr., Wisconsin Rapids, WI (US); James P. Niemiec, Wisconsin Rapids, WI (US); Leonard J. Schliesman, Jr., Wisconsin Rapids, WI (US)

(73) Assignee: Newpage Corporation, Miamisburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/326,915

(22) Filed: Dec. 15, 2011

(65) Prior Publication Data

US 2012/0154502 A1 Jun. 21, 2012

Related U.S. Application Data

(60) Provisional application No. 61/423,408, filed on Dec. 15, 2010.

(51) Int. Cl.
*B41M 5/00* (2006.01)
*B41M 5/52* (2006.01)
*B41M 5/50* (2006.01)

(52) U.S. Cl.
CPC ..... *B41M 5/52* (2013.01); *B41M 5/5254* (2013.01); *B41M 5/506* (2013.01); *B41M 5/5218* (2013.01); *B41M 5/5227* (2013.01); *B41M 5/5236* (2013.01)
USPC ..... 428/32.21; 428/32.26; 428/32.28; 428/32.3; 428/32.31; 428/32.34; 428/32.38

(58) Field of Classification Search
CPC ..... B41M 5/5218; B41M 5/52; B41M 5/506; B41M 5/5254
USPC ..... 428/32.21, 32.26, 32.28, 32.3, 32.31, 428/32.34, 32.38
See application file for complete search history.

(56) References Cited

U.S. PATENT DOCUMENTS

| | | | |
|---|---|---|---|
| 1,941,001 | A | 12/1933 | Hansell |
| 3,197,322 | A | 7/1965 | Maskal et al. |
| 3,373,437 | A | 3/1968 | Sweet et al. |
| 3,416,153 | A | 12/1968 | Hertz et al. |
| 3,798,047 | A | 3/1974 | Delfosse |
| 3,878,519 | A | 4/1975 | Eaton |
| 4,346,387 | A | 8/1982 | Hertz |
| 4,714,603 | A | 12/1987 | Vanderheiden |
| 4,824,654 | A | 4/1989 | Ota et al. |
| 5,120,365 | A | 6/1992 | Kogler |
| 5,164,172 | A | 11/1992 | Katayama et al. |
| 5,269,818 | A | 12/1993 | Kunesh et al. |
| 5,296,002 | A | 3/1994 | Passaretti |
| 5,320,897 | A | 6/1994 | Kondo et al. |
| 5,332,564 | A | 7/1994 | Chapnerkar et al. |
| 5,418,057 | A | 5/1995 | Kokiyoshi et al. |
| 5,454,864 | A | 10/1995 | Whalen-Shaw |
| 5,478,388 | A | 12/1995 | Gane et al. |
| 5,676,746 | A | 10/1997 | Brown |
| 5,731,034 | A | 3/1998 | Husband |
| 5,846,382 | A | 12/1998 | Von Raven |
| 5,861,209 | A | 1/1999 | Haskins et al. |
| 5,879,442 | A | 3/1999 | Nishiguchi et al. |
| 5,882,396 | A | 3/1999 | Hiorns |
| 5,939,036 | A | 8/1999 | Porter et al. |
| 6,071,336 | A | 6/2000 | Fairchild et al. |
| 6,150,289 | A | 11/2000 | Chen et al. |
| 6,156,286 | A | 12/2000 | Fortier et al. |
| 6,207,258 | B1 | 3/2001 | Varnell |
| 6,221,146 | B1 | 4/2001 | Fortier et al. |
| 6,380,265 | B1 | 4/2002 | Pryor et al. |
| 6,402,824 | B1 | 6/2002 | Freeman et al. |
| 6,554,410 | B2 | 4/2003 | Jeanmaire et al. |
| 6,630,229 | B1 | 10/2003 | Normington et al. |
| RE38,301 | E | 11/2003 | Bleakley et al. |
| 6,677,386 | B1 | 1/2004 | Giezen et al. |
| 6,685,908 | B1 | 2/2004 | Yaniv |
| 6,698,880 | B1 | 3/2004 | Campbell et al. |
| 6,780,920 | B2 | 8/2004 | Chapman et al. |
| 6,825,252 | B2 | 11/2004 | Helbling et al. |
| 6,841,609 | B2 | 1/2005 | Chapman et al. |
| 6,863,775 | B2 | 3/2005 | Bobsein et al. |

(Continued)

FOREIGN PATENT DOCUMENTS

| | | |
|---|---|---|
| AU | 2012203595 | 1/2013 |
| EP | 1114735 | 7/2001 |

(Continued)

OTHER PUBLICATIONS

Ichizuka JP 55051583 A, Apr. 1980, Japan—Abstract.*

(Continued)

*Primary Examiner* — Betelhem Shewareged
(74) *Attorney, Agent, or Firm* — Thompson Hine L.L.P.

(57) ABSTRACT

An inkjet recording medium and a coating composition for forming an inkjet recording medium. In accordance with one aspect of the present invention, an inkjet recording medium is disclosed comprising an inkjet-receptive coating on a paper substrate. The inkjet-receptive coating contains a synergistic combination of pigments, binder and a multivalent metal salt such that the inkjet recording medium exhibits improved inkjet print properties, particularly when printed with a high speed inkjet printer using pigmented inks.

19 Claims, No Drawings

(56) References Cited

U.S. PATENT DOCUMENTS

| | | | | |
|---|---|---|---|---|
| 6,921,430 | B2 | 7/2005 | Bloembergen et al. | |
| 7,014,893 | B2 | 3/2006 | Wicher et al. | |
| 7,285,586 | B2 | 10/2007 | Helbling et al. | |
| 7,351,278 | B2 | 4/2008 | Jackson | |
| 7,393,571 | B2 | 7/2008 | Chapman et al. | |
| 7,452,592 | B2 | 11/2008 | Cowton | |
| 7,553,395 | B2 | 6/2009 | Stoffel et al. | |
| 7,615,265 | B2 | 11/2009 | Stork et al. | |
| 7,803,224 | B2 | 9/2010 | Schliesman et al. | |
| 8,092,873 | B2 | 1/2012 | Wang et al. | |
| 8,256,887 | B2 | 9/2012 | Zhou et al. | |
| 8,425,728 | B2 | 4/2013 | Zhou et al. | |
| 8,480,225 | B2 | 7/2013 | Romano, Jr. et al. | |
| 8,562,126 | B1 | 10/2013 | Xiang et al. | |
| 2003/0064208 | A1* | 4/2003 | Yamada et al. | 428/195 |
| 2003/0099816 | A1 | 5/2003 | Liu et al. | |
| 2003/0180478 | A1 | 9/2003 | Fruge et al. | |
| 2003/0191226 | A1 | 10/2003 | Chapman et al. | |
| 2003/0203133 | A1 | 10/2003 | Maekawa | |
| 2004/0080595 | A1 | 4/2004 | Taguchi et al. | |
| 2004/0189778 | A1* | 9/2004 | Stork et al. | 347/105 |
| 2004/0255820 | A1 | 12/2004 | Chen et al. | |
| 2005/0003113 | A1 | 1/2005 | Chen et al. | |
| 2006/0054291 | A1 | 3/2006 | Dimmick et al. | |
| 2006/0060317 | A1 | 3/2006 | Roding et al. | |
| 2006/0061641 | A1 | 3/2006 | Ueki et al. | |
| 2006/0098066 | A1 | 5/2006 | Bauer | |
| 2006/0099408 | A1 | 5/2006 | Andersson et al. | |
| 2006/0102304 | A1 | 5/2006 | Nutbeem et al. | |
| 2006/0112855 | A1 | 6/2006 | Andersson et al. | |
| 2006/0137574 | A1 | 6/2006 | Preston et al. | |
| 2006/0139406 | A1 | 6/2006 | Tsuchiya et al. | |
| 2006/0159910 | A1 | 7/2006 | Song et al. | |
| 2006/0272549 | A1 | 12/2006 | Mathur et al. | |
| 2006/0292305 | A1 | 12/2006 | Skuse et al. | |
| 2007/0237909 | A1 | 10/2007 | McManus | |
| 2008/0008846 | A1 | 1/2008 | Zhou et al. | |
| 2008/0032074 | A1 | 2/2008 | Doi et al. | |
| 2008/0268185 | A1 | 10/2008 | Chen et al. | |
| 2009/0035478 | A1 | 2/2009 | Zhou et al. | |
| 2009/0074995 | A1 | 3/2009 | Dannhauser et al. | |
| 2009/0087568 | A1 | 4/2009 | Kobayashi | |
| 2009/0123675 | A1 | 5/2009 | Shaw-Klein et al. | |
| 2009/0131570 | A1 | 5/2009 | Schliesman et al. | |
| 2009/0169455 | A1 | 7/2009 | Van Aert et al. | |
| 2009/0203643 | A1 | 8/2009 | Patel | |
| 2011/0012970 | A1 | 1/2011 | Zhou et al. | |
| 2011/0037818 | A1 | 2/2011 | Romano, Jr. et al. | |
| 2011/0050827 | A1 | 3/2011 | Romano, Jr. et al. | |
| 2011/0052818 | A1 | 3/2011 | Osterberg et al. | |
| 2011/0069106 | A1 | 3/2011 | Song et al. | |
| 2011/0104406 | A1 | 5/2011 | Zhou et al. | |
| 2011/0279554 | A1 | 11/2011 | Dannhauser et al. | |
| 2012/0012264 | A1 | 1/2012 | Zhou et al. | |
| 2012/0034398 | A1 | 2/2012 | Wang et al. | |
| 2012/0038701 | A1 | 2/2012 | Schalkhammer et al. | |
| 2012/0114880 | A1 | 5/2012 | Nagoshi et al. | |
| 2012/0212555 | A1 | 8/2012 | Romano, Jr. | |

FOREIGN PATENT DOCUMENTS

| | | | | |
|---|---|---|---|---|
| EP | 2196320 | | 6/2010 | |
| JP | 55-51583 | * | 4/1980 | B41M 5/00 |
| WO | 03/031191 | | 4/2003 | |
| WO | 03/031191 | A2 | 4/2003 | |
| WO | 03/031191 | A3 | 4/2003 | |
| WO | 2004/005039 | | 1/2004 | |
| WO | 2004/061014 | | 7/2004 | |
| WO | 2006/116878 | | 11/2006 | |
| WO | 2007/112013 | | 10/2007 | |
| WO | 2009/095697 | | 8/2009 | |
| WO | 2009/110910 | | 9/2009 | |
| WO | 2010/065750 | | 6/2010 | |
| WO | 2010/114560 | | 10/2010 | |
| WO | 2011/019866 | | 2/2011 | |
| WO | 2011/026070 | | 3/2011 | |
| WO | 2012/057790 | | 5/2013 | |
| WO | 2013/095373 | | 6/2013 | |

OTHER PUBLICATIONS

PCT, International Search Report and Written Opinion, International Application No. PCT/US2011/065147 (Apr. 16, 2012).

Dimmick, A.C., "Effects of Sheet Moisture and Calender Pressure on PCC and GCC Coated Papers," TAPPI Journal (Nov. 2007).

Hugener, P. et al., "A New Coating Ground Calcium Carbonate for Enhanced Paper Properties" (Apr. 26, 2010).

Lee, D.I. et al., "Development of New Biobased Emulsion Binders," presented at TAPPI PaperCon 2010, Talent, Technology and Transformation, Atlanta, GA (May 2-5, 2010).

Press Release, Kodak Focuses on Delivering Offset Class Quality, Providing Scaleable Solutions with Inkjet Printing Systems (Jan. 17, 2008).

Product Information, "Hydrafine® Kaolin Clay," KaMin Performance Minerals (2009).

Product Information, "Hydragloss® 90 Kaolin Clay," KaMin Performance Minerals (2009).

Product Information, "Sylojet® C30 Cationic Porous Silica Dispersion for Ink Jet and Other Functional Coatings," W.R. Grace & Co. (Mar. 26, 2009).

Svanholm, "An Experimental Study of Inkjet Receptive Coatings" (Nov. 15, 2004).

Svanholm, Eric., "Printability and Ink-Coating Interactions in Inkjet Printing", Faculty of Technology and Science Chemical Engineering, Dissertation, Karlstad University Studies, 2007:2.

Wilson, I., "Filler and Coating Pigments and Papermakers," Industrial Minerals & Rocks: Commodities, Markets, and Uses, 7th Edition, pp. 1287-1300 (2006).

"Formulation Guide for Ecosphere® Biolatex Binders," by EcoSynthetix Inc. (2010).

"Technical Data Sheet. Ecosphere® 2240 biolatex® binder for coated paper and paperboard," by EcoSynthetix Inc. (2010).

* cited by examiner

RECORDING MEDIUM FOR INKJET PRINTING

CROSS REFERENCE TO RELATED APPLICATION

The present application claims the benefit of U.S. Provisional Application Ser. No. 61/423,408 filed Dec. 15, 2010, the contents of which are hereby incorporated by reference.

BACKGROUND

The present application relates to an inkjet recording medium and a coating composition for forming an inkjet recording medium. More specifically, the inkjet coating composition disclosed herein contains a multivalent salt and the resulting recording medium is particularly useful for high speed multi-color printing such as high speed inkjet printing.

Traditionally, commercial printing presses printed catalogs, brochures and direct mail use offset printing. However, advances in inkjet technology have led to increased penetration into commercial print shops. Inkjet technology provides a high-quality alternative to offset printing for improving response rates, reducing cost, and increasing demand for products. In addition to printing high quality variable images and text, these printers incorporate a roll-fed paper transport system that enables fast, high-volume printing. Inkjet technology is now being used for on-demand production of local magazines, newspapers, small-lot printing, textbooks, and transactional printing world wide.

Continuous inkjet systems are being developed that enable offset class quality, productivity, reliability and cost with the full benefits of digital printing for high volume commercial applications. These systems allow continuous inkjet printing to expand beyond the core base of transactional printers and secondary imprinting and into high volume commercial applications. Kodak's STREAM Inkjet technology is one example of such a system.

In accordance with certain aspects of the present invention, a recording medium is described which provides fast drying times, high gloss and excellent image quality when printed using high speed inkjet devices used in commercial printing applications.

U.S. Pat. App. Pub. No. 2009/0131570 entitled "Paper and Coating Medium for Multifunction Printing" (Schliesman, et al.) discloses an inkjet recording medium that is compatible with offset, inkjet, and laser printing. While the disclosed formulation works well with many commercial inkjet printers, it performs poorly with the KODAK STREAM printer. The contents of the '570 publication are hereby incorporated by reference.

SUMMARY

The present application describes an inkjet recording medium and a coating composition for forming an inkjet recording medium. In accordance with one aspect of the present invention, an inkjet recording medium is disclosed comprising an inkjet-receptive coating on a paper substrate. The inkjet-receptive coating contains a synergistic combination of pigments, binder and a multivalent salt such that the inkjet recording medium exhibits improved inkjet print properties, particularly when printed with a high speed inkjet printer using pigmented or dye based inks.

In accordance with certain embodiments, the paper coating includes a combination of a primary pigment and a secondary pigment. The primary pigment typically includes anionic particles having a particle size distribution where at least 96% of the particles by weight have a particle size less than 2 microns. The secondary pigment may be a cationic, grit-free pigment having an average particle size of 3 microns or less. The coating also includes a binder and, optionally, a co-binder. Typically, a multi-valent salt and a dispersant may also be included in the coating composition.

Aragonite is a particularly useful precipitated calcium carbonate that differs from other forms of calcium carbonate in both particle shape and size distribution. It is particularly useful as the primary pigment. Aragonite has a needle-like structure and a narrow particle size distribution making it particularly suitable as the primary pigment. While not wishing to be bound by theory, it is believed that the structure discourages tight particle packing of the pigment and provides the porosity needed for good ink absorption from different printing techniques. Use of the aragonite form produces a surface on the treated paper having a controlled porosity that allows it to perform well with any printing process.

Another embodiment relates to a coated sheet that includes a paper substrate to which the above coating has been applied. The coated sheet is highly absorbent for many types of ink. It quickly absorbs ink from several passes of an ink jet printer.

The coating and coated paper of the instant invention are particularly useful with both dye and pigmented ink jet inks.

DETAILED DESCRIPTION

The coating for producing the inkjet recording medium typically includes at least two pigments, a primary pigment and a secondary pigment. The primary pigment may be a narrow particle size distribution, precipitated, anionic pigment. The secondary pigment may be a cationic pigment. The pigments typically are inorganic pigments. Further, the coating typically includes a binder and, optionally, a co-binder. Pigments typically comprise the largest portion of the coating composition on a dry weight basis. Unless otherwise noted, amounts of component materials are expressed in terms of component parts per 100 parts of total pigment on a weight basis.

The primary component of the coating may be an anionic pigment having a narrow particle size distribution where 96% of the particles are less than 2 microns in diameter. Preferably, at least 80% by weight of the particles should be less than 1 micron and fall within the range of 0.1-1μ. In another embodiment, the distribution has at least 85% of the particles less than 1 micron and fall in the range of 0.1-1 microns. In another embodiment, 98% of the particles are less than 2 microns in diameter. Yet another embodiment uses a calcium carbonate wherein about 98% of the particles fall in the range of 0.1-1.0 microns. In accordance with certain embodiments, the primary pigment is from about 35 to about 85 parts, more particularly from about 60 to about 76 parts, of the total pigment by weight.

Calcium carbonate is useful as the primary pigment in any form, including aragonite, calcite or mixtures thereof. Calcium carbonate, when present as the primary pigment, typically makes up 35-85 parts of the coating pigment on a dry weight basis. In certain embodiments, the calcium carbonate may be from about 60 to 76 parts of the pigment weight. Aragonite is a particularly useful calcium carbonate. An advantage to using aragonite as the primary pigment is that the porous structure of the coating better withstands calendering to give it a gloss finish. When other forms of calcium carbonate are used in coatings, surface pores can be compacted so that some absorbency can be lost before a significant amount of gloss is achieved. A particularly useful aragonite is Specialty Minerals OPACARB A40 pigment (Specialty Minerals, Inc., Bethlehem, Pa.). A40 has a particle size distribution where 99% of the particles have a diameter of from about 0.1 to about 1.1 microns.

For the primary pigment, an alternate calcium carbonate having a narrow particle size distribution is OMYA Cover-Carb 85 ground calcite calcium carbonate (OMYA AG, Oftringen, Switzerland). It provides the porous structure for successful ink absorption but less paper gloss development. This calcium carbonate, in accordance with certain embodiments, has a particle size distribution where 99% of the particles have a diameter less than 2 microns.

The secondary pigment typically is a cationic pigment. It is added to the coating which, when fully assembled, typically has an overall anionic nature. Attractive forces between the anionic coating and cationic pigment are believed to open up surface pores in the coating, increasing the porosity and the ink absorption rate. Ink drying times are also reduced. Additionally, since the ionic interaction is on a very small scale, the improved porosity is uniform over the coating surface.

The particle size distribution of the secondary pigment typically has an average particle size less than 3.0 microns and typically is grit-free. The term "grit-free" is intended to mean there are substantially no particles on a 325 mesh screen. In some embodiments, substantially all of the particles in the secondary pigment are sized at less than 1 micron. Amounts of the secondary pigment are typically less than 20 parts based on 100 parts by weight of the total pigment. Use of excessive cationic component may lead to undesirable ionic interaction and chemical reactions that can change the nature of the coating. The secondary pigment may be present in amounts greater than 5 parts cationic pigment per 100 total parts pigment. The secondary pigment may be present in amounts from about 5-50 parts, more particularly from about 8-16 parts. Examples of secondary pigments include carbonates, silicates, silicas, titanium dioxide, aluminum oxides and aluminum trihydrates. Particularly useful secondary pigments include cationic OMYAJET B and 5010 pigments (OMYA AG, Oftringen, Switzerland).

Supplemental pigments are optional and may include anionic pigments used in the formulation as needed to improve gloss, whiteness or other coating properties. Up to an additional 30 parts by weight of the dry coating pigment may be an anionic supplemental pigment. Up to 25 parts, more particularly less than 20 parts, of the pigment may be a coarse ground calcium carbonate, another carbonate, plastic pigment, $TiO_2$, or mixtures thereof. An example of a ground calcium carbonate is Carbital 35 calcium carbonate (Imerys, Roswell, Ga.). Another supplemental pigment is anionic titanium dioxide, such as that available from Itochu Chemicals America (White Plains, N.Y.). Hollow spheres are particularly useful plastic pigments for paper glossing. Examples of hollow sphere pigments include ROPAQUE 1353 and ROPAQUE AF-1055 (Rohm & Haas, Philadelphia, Pa.). Higher gloss papers are obtainable when fine pigments are used that have a small particle size. The relative amounts of the supplemental pigments are varied depending on the whiteness and desired gloss levels.

A primary binder is added to the coating for adhesion. The primary binder typically is compatible with the incorporation of a multivalent salt and the pigments in the coating formulation and typically is non-ionic. In accordance with certain embodiments, the binder may be a biopolymer such as a starch or protein. In accordance with particularly useful embodiments, the polymer may comprise biopolymer particles, more particularly biopolymer microparticles and in accordance with certain embodiments, biopolymer nanoparticles. In accordance with particularly useful aspects, the biopolymer particles comprise starch particles and, more particularly, starch nanoparticles having an average particle size of less than 400 nm. Compositions containing a biopolymer latex conjugate comprising a biopolymer-additive complex reacted with a crosslinking agent as described in WO 2010/065750 are particularly useful. Biopolymer-based binders and, in particular, those binders containing biopolymer particles have been found to be compatible with the inclusion of a multivalent salt in the coating formulation and facilitate coating production and processing. For example, in some cases coating compositions can be prepared at high solids while maintaining acceptable viscosity for the coating composition. Biopolymer binders that may find use in the present application are disclosed in U.S. Pat. Nos. 6,677,386; 6,825,252; 6,921,430; 7,285,586; and 7,452,592, and WO 2010/065750, the relevant disclosure in each of these documents is hereby incorporated by reference. One example of a suitable binder containing biopolymer nanoparticles is Ecosphere®2240 available from Ecosynthetix Inc.

The binder may also be a synthetic polymeric binder. In accordance with certain embodiments, the binder may be a non-ionic synthetic latex such as an acrylate or an acrylate copolymer. In accordance with other embodiments, the binder may be a calcium stable vinyl acetate or a styrene butadiene latex.

The binder may also be a synthetic polymeric binder such as polyvinyl alcohol, polyvinyl pyrrolidone, polyethlyene oxide, acrylates, polyurethanes, etc.

The total amount of primary binder typically is from about 2 to about 15, more particularly about 5 to about 12, parts per 100 parts of total pigments. In accordance with certain embodiments, a binder containing biopolymer particles may be the only binder in the coating composition.

The coating may also include a co-binder that is used in addition to the primary binder. Examples of useful co-binders include polyvinyl alcohol and protein binders. The co-binder, when present, typically is used in amounts of about 1 to about 8 parts co-binder per 100 parts of pigment on a dry weight basis, more particularly from about 2 to 5 parts co-binder per 100 parts dry pigment. Another co-binder that is useful in some embodiments is starch. Both cationic and anionic starches may be used as a co-binder. ADM Clineo 716 starch is an ethylated cornstarch (Archer Daniels Midland, Clinton, Iowa). Penford PG 260 is an example of another starch co-binder that can be used. If a cationic co-binder is used, the amount used typically is limited so that the overall anionic nature of the coating is maintained. The binder levels should be carefully controlled. If too little binder is used, the coating structure may lack physical integrity, while if too much binder is used, the coating may become less porous resulting in longer ink drying times.

In accordance with some embodiments, the coating is substantially free (for example, no more than 0.2 parts) of any SBR latex binder that is not calcium stable.

The coating composition also includes a multivalent salt. In certain embodiments of the invention, the multivalent metal is a divalent or trivalent cation. More particularly, the multivalent metal salt may be a cation selected from $Mg^{+2}$, $Ca^{+2}$, $Ba^{+2}$, $Zn^{+2}$, and $Al^{+3}$, in combination with suitable counter ions. Divalent cations such as $Ca^{+2}$ and $Mg^{+2}$ are particularly useful. Combinations of cations may also be used.

Specific examples of the salt used in the coating include (but are not limited to) calcium chloride, calcium acetate, calcium nitrate, magnesium chloride, magnesium acetate, magnesium nitrate, magnesium sulfate, barium chloride, barium nitrate, zinc chloride, zinc nitrate, aluminum chloride, aluminum hydroxychloride, and aluminum nitrate. Similar salts will be appreciated by the skilled artisan. Particularly useful salts include $CaCl_2$, $MgCl_2$, $MgSO_4$, $Ca(NO_3)_2$, and $Mg(NO_3)_2$, including hydrated versions of these salts. Combinations of the salts may also be used. The salt may be present in the coating in an amount of about 2.5 to 25 parts, more particularly about 4 to 12.5 parts by weight based per 100 total parts of pigment.

A water retention aid may also be included in the coating to improve water retention. Coatings containing multivalent ions can lack sufficient water holding capability for commercial applications. In addition to increasing water retention, a secondary advantage is that it unexpectedly enhances the binding strength of the biopolymer. Tape pulls indicate better strength in coating formulations including a retention aid. Examples of water retention aids for use herein include, but are not limited to, polyethylene oxide, hydroxyethyl cellulose, polyvinyl alcohol, starches, and other commercially available products sold for such applications. One specific example of a suitable retention aid is Natrasol GR (Aqualon). In accordance with certain embodiments, the water retention aid is present in an amount of about 0.1 to 2 parts, more particularly about 0.2 to 1 part per 100 parts of total pigments.

In accordance with some aspects, the coating composition may contain a dispersant that enables the composition to be formulated at a high solids content and yet maintain an acceptable viscosity. However, due to the particular components utilized to prepare the high solids coatings, typically used dispersants may not be suitable because they may lead to unacceptable viscosities. Dispersants, when included in the formulation, are typically used in amounts of about 0.2-2 parts, more particularly about 0.5-1.5 parts per 100 parts of total pigments. Dispersants that have been found to be suitable for this particular application of the coating composition include dispersants containing polyether polycarboxylate salts and polyoxyalkylene salts. Specific examples include, without limitation, the following:

| Product Name | Manufacturer | Chemical Nature |
|---|---|---|
| XP1838 | Coatex | Polyether polycarboxylate, sodium salt in aqueous solution |
| Carbosperse K-XP228 | Lubrizol | Polyoxyalkylene sodium salt |

Other optional additives may be used to vary properties of the coating. Brightening agents, such as Clariant T26 Optical Brightening Agent, (Clariant Corporation, McHenry, Ill.) can be used. Insolubilizers or cross-linkers may be useful. A particularly useful cross-linker is Sequarez 755 (RohmNova, Akron, Ohio). A lubricant is optionally added to reduce drag when the coating is applied with a blade coater. Diglyceride lubricants are particularly useful in accordance with certain embodiments. These optional additives, when present, are typically present in an amount of about 0.1 to 5 parts, more particularly about 0.2 to 2 parts per 100 parts of total pigments.

Conventional mixing techniques may be used in making this coating. If starch is used, it typically is cooked prior to preparing the coating using a starch cooker. In accordance with certain embodiments, the starch may be made down to approximately 35% solids. Separately, all of the pigments, including the primary pigment, secondary and any supplemental pigments, may be mixed for several minutes to ensure no settling has occurred. In the laboratory, the pigments may be mixed on a drill press mixer using a paddle mixer. The primary binder is then added to the mixer, followed by the co-binder 1-2 minutes later. If starch is used, it is typically added to the mixer while it is still warm from the cooker, approximately 190° F. The final coating is made by dispersion of the mixed components in water. Solids content of the dispersion typically is from about 35% to about 60% by weight. More particularly, the solids may be about 45% to about 55% of the dispersion by weight.

Yet another embodiment relates to an improved printing paper having a paper substrate to which the coating has been applied on at least one surface. Any coating method or apparatus may be used, including, but not limited to, roll coaters, jet coaters, blade coaters or rod coaters. The coating weight is typically about 2 to about 10, more particularly about 5 to about 8, pounds per 3300 ft.$^2$ per side, to size press, pre-coated or unsized base papers. Coated papers would typically range from about 30 lb. to about 250 lb./3300 ft.$^2$ of paper surface. The coated paper is then optionally finished using conventional methods to the desired gloss.

The substrate or base sheet may be a conventional base sheet. Examples of useful base sheets include, Newpage 45 lb, Pub Matte, NewPage 45 lb New Era, NewPage 60 lb. Web Offset base paper, Orion, and NewPage 105 lb. Satin Return Card Base Stock, both from NewPage Corporation (Wisconsin Rapids, Wis.).

The finished coated paper is useful for printing Ink is applied to the coating to create an image. After application, the ink vehicle penetrates the coating and is absorbed therein. The number and uniformity of the coating pores result in even and rapid ink absorption, even when multiple layers of ink are applied. This coated paper may also be well suited for multifunctional printing, whereby an image on a coated paper media is created from combinations of dyes or pigmented inks from ink jet printers, toner from laser printers and inks from gravure or flexo presses.

The following non-limiting examples illustrate specific aspects of the present invention.

A formulation comprising 9.5 parts of coarse carbonate, 12 parts of Omyajet 5010, 10 parts of Ecosphere, 10 parts of calcium chloride, 10.5 parts of Ropaque AF-1353, and 68 parts of Opacarb A-40 provides excellent dry time and image quality when printed with a Kodak 5300 printer. This printer simulates the performance observed with Kodak high speed STREAM printer.

The formulations below were coated on 60# base paper manufactured at the NewPage, Wickliffe, Ky. mill by means of a blade coater at 6.5 lbs (per 3,300 ft.$^2$). The base paper used for this example typically contains a mixture of softwood and hardwood fibers. Softwood fibers typically are present in an amount of about 0-25% and hardwood fibers are present in an amount of about 100-75%. In accordance with a particularly useful base paper, the softwood and hardwood fibers are present in a ratio of 15% to 85%, respectively. The base paper typically includes from about 40-50 lb/ton size press starch and in particular embodiments about 45 lb/ton size press starch.

The ink jet receptive coatings were calendered at 1200 PLI/100° F. using 3 nips/side. A test target was printed on the resulting paper with a Kodak 5300 printer containing standard Kodak pigmented inks A blue Dmax patch was measured for mottle using a Personal IAS Image Analysis System manufactured by QEA. Mottle is a density non-uniformity that occurs at a low spatial frequency (i.e. noise at a coarse scale). The units of mottle are percent reflectance using the default density standard and color filter specified in the software. A lower mottle value indicates better performance. The density of the blue patch was measured with a X-Rite 418 densitometer. The ratio of density to mottle was measured. Since high density and low mottle is desirable, a higher ratio indicated better performance. In accordance with certain aspects of the present invention, density/mottle values of greater than 1.6, and in certain cases greater than 1.8 can be obtained. In accordance with certain embodiments, an inkjet recording medium can be produced having density/mottle ratios of at least 1.0, more particularly at least 1.3 and in certain cases at least 1.5.

Comparative samples were also printed using the Kodak 5300 printer and evaluated in the same manner as the test samples. Comparative Example 1, NewPage 80 lb Sterling Ultra Gloss (SUG), is a commercial coated paper coated on both sides with a coating containing clay, calcium carbonate and a latex binder. The coat weights on each side typically are about 8-9 lbs/ream on a 62 lb. base sheet for a coated sheet with a nominal weight of 80 lb. Comparative Example 2 corresponds to one of the formulations disclosed in U.S. Pat. App. Pub. No. 2009/0131570 entitled "Paper and Coating Medium for Multifunction Printing" (Schliesman, et al.).

The results in Table 1 show that the inventive examples exhibit improved mottle and density/mottle value compared to the comparative examples.

TABLE 2

Non-limiting Coating Formulation Ranges

| Generic Material | Broad Range Dry Parts | Narrow Range Dry Parts | Example Material |
|---|---|---|---|
| Supplemental Pigment | 0-30 | 5-15 | Coarse Carbonate |
| Secondary Pigment | 5-50 | 8-16 | Omyajet 5010 |
| Primary Binder | 2-15 | 5-12 | Ecosphere, non-ionic SB latex |
| Co-binder | 0-10 | 2-7.5 | Starch |
| Salt | 2.5-25 | 4-12.5 | Calcium Chloride |
| Supplemental Pigment | 0-30 | 5-15 | Ropaque AF-1353 |
| Primary Pigment | 35-85 | 65-76 | Opacarb A-40 |
| Crosslinker | 0-1 | 0.25-0.7 | Sequarez 755 |
| Lubricant | 0-1 | 0.4-0.8 | Berchem 4113 |
| Water Retention aid | 0-2 | 0.2-1 | Hydroxyethyl cellulose |

The effects of incorporating a dispersant into the formulation were evaluated by preparing compositions containing Ecosphere 2240 with different dispersants and measuring viscosity (Brookfield viscosity at 90° F.) as set forth in Tables 3A and 3B.

Table 1A: Non-limiting Coating Formulation Examples

| Coating Formulation | Invention Example 1 | Invention Example 2 | Invention Example 3 | Invention Example 4 | Invention Example 5 | Invention Example 6 |
|---|---|---|---|---|---|---|
| Opacarb A-40 | 68 | 68 | 37.5 | 68 | 68 | 68 |
| Coarse Carbonate CC-35 | 9.5 | 9.5 | | 9.5 | 9.5 | 9.5 |
| Omyajet 5010 | 12 | 12 | 45.8 | | 12 | 12 |
| Gencryl 8181 Latex | | | | | | |
| Penford 280 Starch | | 7.5 | 10 | 5 | | |
| Ecosphere 2240 | 7.5 | | | 5 | 10 | 10 |
| Ropaque AF-1353 | 10.5 | 10.5 | 16.7 | 10.5 | 10.5 | 10.5 |
| Calcium chloride | 10 | 10 | 20 | 5 | 10 | 5 |
| Sequarez 755 | 0.5 | 0.5 | 0.5 | 0.5 | 0.5 | 0.5 |
| Berchem 4113 | | | | 0.65 | | |
| Natrosol 250 GR HEC | | | | | 0.5 | 0.5 |
| Mottle | 0.795 | 0.889 | 0.758 | 0.794 | 0.708 | 0.753 |
| Density | 1.43 | 1.44 | 1.28 | 1.29 | 1.31 | 1.36 |
| Density/Mottle | 1.8 | 1.62 | 1.69 | 1.63 | 1.85 | 1.81 |

Table 1B: Comparative Coating Formulation Examples

| Coating Formulation | Comparative Example 1 80 lb SUG | Comparative Example 2 |
|---|---|---|
| Opacarb A-40 | | 74 |
| Coarse Carbonate CC-35 | | 9.5 |
| Omyajet 5010 | | 8.5 |
| Gencryl 8181 Latex | | 8 |
| Penford 280 Starch | | 3 |
| Ecosphere 92240 | | |
| Ropaque AF-1353 | | 8 |
| Calcium chloride | | |
| Sequarez 755 | | 0.5 |
| Berchem 4113 | | |
| Natrosol 250 GR HEC | | |
| Mottle | 13.67 | 6.66 |
| Density | 0.95 | 1.08 |
| Density/Mottle | 0.07 | 0.16 |

TABLE 3A

| Dispersant Evaluation | | | | | |
|---|---|---|---|---|---|
| Coating Formulations | Example 7 Dry Parts | Example 8 Dry Parts | Example 9 Dry Parts | Example 10 Dry Parts | Example 11 Dry Parts |
| A-40 | 74 | 74 | 74 | 74 | 74 |
| AF-1353 | 8 | 8 | 8 | 8 | 8 |
| CGC | 9.5 | 9.5 | 9.5 | 9.5 | 9.5 |
| OmyaJet 5010 | 8.5 | 8.5 | 8.5 | 8.5 | 8.5 |
| EcoSphere 2240 | 10 | 10 | 10 | 10 | 10 |
| Sequarez 755 | 0.5 | 0.5 | 0.5 | 0.5 | 0.5 |
| XP1838 | | 1 | | | |
| Carbosperse K XP228 | | | 1 | | |
| DisperBYK 190 | | | | 1 | |
| DisperBYK 2010 | | | | | 1 |
| DisperBYK 199 | | | | | |
| DisperBYK 2015 | | | | | |
| Anti-Terra 250 | | | | | |
| CaCl2 | | 5 | 5 | 5 | 5 |
| Brookfield Visc. | | | | | |
| @ 90° F./20 RPM (cps.) | 6200 | 10800 | 8250 | 40750 | 30500 |
| Spindle | 4 | 5 | 4 | 6 | 6 |

TABLE 3B

| Dispersant Evaluation | | | | |
|---|---|---|---|---|
| Coating Formulations | Example 12 Dry Parts | Example 13 Dry Parts | Example 14 Dry Parts | Example 15 Dry Parts |
| A-40 | 74 | 74 | 74 | 74 |
| AF-1353 | 8 | 8 | 8 | 8 |
| CGC | 9.5 | 9.5 | 9.5 | 9.5 |
| OmyaJet 5010 | 8.5 | 8.5 | 8.5 | 8.5 |
| EcoSphere 2240 | 10 | 10 | 10 | 10 |
| Sequarez 755 | 0.5 | 0.5 | 0.5 | 0.5 |
| XP1838 | | | | |
| Carbosperse K XP228 | | | | |
| DisperBYK 190 | | | | |
| DisperBYK 2010 | | | | |
| DisperBYK 199 | 1 | | | |
| DisperBYK 2015 | | 1 | | |
| Anti-Terra 250 | | | 1 | |
| CaCl2 | 5 | 5 | 5 | 5 |
| Brookfield Visc. | | | | |
| @ 90° F./20 RPM (cps.) | 23500 | 49750 | 35250 | Too thick to measure |
| Spindle | 6 | 6 | 6 | |

The effects of incorporating a dispersant into the formulation were evaluated by preparing compositions containing a conventional SB latex (Gencryl 9525) with different dispersants and measuring viscosity (Brookfield viscosity at 90° F.) as set forth in Tables 4A and 4B.

TABLE 4A

| Dispersant Evaluation | | | | | |
|---|---|---|---|---|---|
| Coating Formulations | Example 16 Dry Parts | Example 17 Dry Parts | Example 18 Dry Parts | Example 19 Dry Parts | Example 20 Dry Parts |
| A-40 | 74 | 74 | 74 | 74 | 74 |
| AF-1353 | 8 | 8 | 8 | 8 | 8 |

TABLE 4A-continued

| Dispersant Evaluation | | | | | |
|---|---|---|---|---|---|
| Coating Formulations | Example 16 Dry Parts | Example 17 Dry Parts | Example 18 Dry Parts | Example 19 Dry Parts | Example 20 Dry Parts |
| CGC | 9.5 | 9.5 | 9.5 | 9.5 | 9.5 |
| OmyaJet 5010 | 8.5 | 8.5 | 8.5 | 8.5 | 8.5 |
| PG260 | 3 | 3 | 3 | 3 | 3 |
| OMNOVA Gencryl 9525 | 8 | 8 | 8 | 8 | 8 |
| Sequarez 755 | 0.5 | 0.5 | 0.5 | 0.5 | 0.5 |
| XP1838 | | 1 | | | |
| Carbosperse K XP228 | | | 1 | | |
| DisperBYK 190 | | | | 1 | |
| DisperBYK 2010 | | | | | 1 |
| DisperBYK 199 | | | | | |
| DisperBYK 2015 | | | | | |
| Anti-Terra 250 | | | | | |
| CaCl2 | | 5 | 5 | 5 | 5 |
| Brookfield Visc. | | | | | |
| @ 90° F./20 RPM (cps.) | 5700 | Too thick to measure | 37500 | 53000 | Too thick to measure |
| Spindle | 4 | | 6 | 7 | |

TABLE 4B

| Dispersant Evaluation | | | | |
|---|---|---|---|---|
| Coating Formulations | Example 21 Dry Parts | Example 22 Dry Parts | Example 23 Dry Parts | Example 24 Dry Parts |
| A-40 | 74 | 74 | 74 | 74 |
| AF-1353 | 8 | 8 | 8 | 8 |
| CGC | 9.5 | 9.5 | 9.5 | 9.5 |
| OmyaJet 5010 | 8.5 | 8.5 | 8.5 | 8.5 |
| PG260 | 3 | 3 | 3 | 3 |
| OMNOVA Gencryl 9525 | 8 | 8 | 8 | 8 |
| Sequarez 755 | 0.5 | 0.5 | 0.5 | 0.5 |
| XP1838 | | | | |
| Carbosperse K XP228 | | | | |
| DisperBYK 190 | | | | |
| DisperBYK 2010 | | | | |
| DisperBYK 199 | 1 | | | |
| DisperBYK 2015 | | 1 | | |
| Anti-Terra 250 | | | 1 | |
| CaCl2 | 5 | 5 | 5 | 5 |
| Brookfield Visc. | | | | |
| @ 90° F./20 RPM (cps.) | Too thick to measure | 78000 | Too thick to measure | Too thick to measure |
| Spindle | | 7 | | |

The effects of incorporating a dispersant into the formulation were evaluated by preparing compositions containing a non-ionic SB latex (XL2800) with different dispersants and measuring viscosity (Brookfield viscosity at 90° F.) as set forth in Tables 5A and 5B.

TABLE 5A

| Dispersant Evaluation | | | | | |
|---|---|---|---|---|---|
| Coating Formulations | Example 25 Dry Parts | Example 26 Dry Parts | Example 27 Dry Parts | Example 28 Dry Parts | Example 29 Dry Parts |
| A-40 | 74 | 74 | 74 | 74 | 74 |
| AF-1353 | 8 | 8 | 8 | 8 | 8 |
| CGC | 9.5 | 9.5 | 9.5 | 9.5 | 9.5 |
| OmyaJet 5010 | 8.5 | 8.5 | 8.5 | 8.5 | 8.5 |
| PG260 | 3 | 3 | 3 | 3 | 3 |
| OMNOVA XL2800 | 6.5 | 6.5 | 6.5 | 6.5 | 6.5 |
| Sequarez 755 | 0.5 | 0.5 | 0.5 | 0.5 | 0.5 |
| XP1838 | | 1 | | | |
| Carbosperse K | | | 1 | | |
| XP228 | | | | | |
| DisperBYK 190 | | | | 1 | |
| DisperBYK 2010 | | | | | 1 |
| DisperBYK 199 | | | | | |
| DisperBYK 2015 | | | | | |
| Anti-Terra 250 | | | | | |
| CaCl2 | | 5 | 5 | 5 | 5 |
| % Solids | 54.4 | 55.6 | 55.0 | 55.4 | 55.7 |
| Brookfield Visc. | | | | | |
| @ 90° F./20 RPM (cps.) | 4400 | 7100 | 2350 | 28500 | 17750 |
| Spindle | 4 | 4 | 4 | 6 | 6 |

TABLE 5B

| Dispersant Evaluation | | | | |
|---|---|---|---|---|
| Coating Formulations | Example 30 Dry Parts | Example 31 Dry Parts | Example 32 Dry Parts | Example 33 Dry Parts |
| A-40 | 74 | 74 | 74 | 74 |
| AF-1353 | 8 | 8 | 8 | 8 |
| CGC | 9.5 | 9.5 | 9.5 | 9.5 |
| OmyaJet 5010 | 8.5 | 8.5 | 8.5 | 8.5 |
| PG260 | 3 | 3 | 3 | 3 |
| OMNOVA XL2800 | 6.5 | 6.5 | 6.5 | 6.5 |
| Sequarez 755 | 0.5 | 0.5 | 0.5 | 0.5 |
| XP1838 | | | | |
| Carbosperse K | | | | |
| XP228 | | | | |
| DisperBYK 190 | | | | |
| DisperBYK 2010 | | | | |
| DisperBYK 199 | 1 | | | |
| DisperBYK 2015 | | 1 | | |
| Anti-Terra 250 | | | 1 | |
| CaCl2 | 5 | 5 | 5 | 5 |
| % Solids | 55.5 | 55.8 | 55.7 | 56.3 |
| Brookfield Visc. | | | | |
| @ 90° F./20 RPM (cps.) | 35250 | 32750 | 29500 | 90000 |
| Spindle | 6 | 6 | 6 | 7 |

The XP-1838 and Carbosperse dispersants provided the best results with respect to viscosity of the coating composition.

What is claimed is:

1. An inkjet recording medium comprising:

a paper substrate; and an inkjet-receptive coating comprising a primary pigment having a particle size distribution where at least 96% of the particles by weight have a particle size less than 2 microns;

a secondary pigment having an average particle size of 3 microns or less; the primary pigment comprises calcium carbonate;

a multivalent salt;

a dispersant selected from the group consisting of dispersants containing polyether polycarboxylate salts, dispersants containing polyoxyalkylene salts and combinations thereof; and a binder wherein said binder is present in an amount from about 2 to 15 parts by weight of based on 100 parts total pigments.

2. The inkjet recording medium of claim 1 wherein the binder comprises a biopolymer.

3. The inkjet recording medium of claim 1 wherein the binder is a calcium stable vinyl acetate or styrene butadiene latex.

4. The inkjet recording medium of claim 3 wherein said binder comprises biopolymer particles.

5. The inkjet recording medium of claim 4 wherein said binder comprises starch nanoparticles.

6. The inkjet recording medium of claim 5 wherein said nanoparticles have an average particle size of less than 400 nm.

7. The inkjet recording medium of claim 6 wherein said binder comprises a biopolymer latex conjugate comprising a biopolymer-additive complex reacted with a crosslinking agent.

8. The inkjet recording medium of claim 1 wherein said coating comprises a retention aid present in an amount of about 0.1 to 1 part per 100 parts of total pigments.

9. The inkjet recording medium of claim 1 wherein the primary pigment comprises aragonite.

10. The inkjet recording medium of claim 1 further comprising at least one secondary pigment selected from the group consisting of calcium carbonate and plastic pigments.

11. The inkjet recording medium of claim 1 wherein said medium has a density to mottle value of at least 1.5 when printed with a pigmented inkjet ink.

12. The inkjet recording medium of claim 1 wherein said coating further comprises a co-binder selected from the group consisting of protein binders, polyvinyl alcohol, starch and mixtures thereof.

13. The inkjet recording medium of claim 1 wherein said primary pigment is present in an amount of about 35 to 85 parts based on 100 parts total pigments.

14. The inkjet recording medium of claim 1 wherein said coating further comprises a plastic pigment present in an amount of about 2 to 12 parts per 100 parts total pigments.

15. The inkjet recording medium of claim 1 wherein said coating is present at a coat weight of about 2 to 8 lbs./ream (3,300 ft.$^2$).

16. The inkjet recording medium of claim 1 wherein the multivalent metal salt is selected from the group consisting of calcium chloride, calcium acetate, calcium nitrate, magnesium chloride, magnesium acetate, magnesium nitrate, magnesium sulfate, barium chloride, barium nitrate, zinc chloride, zinc nitrate, aluminum chloride, aluminum hydroxychloride, aluminum nitrate and mixtures thereof.

17. The inkjet recording medium of claim 16 wherein the multivalent metal salt comprises calcium chloride.

18. The inkjet recording medium of claim 1 wherein said binder comprises starch.

19. An inkjet recording medium comprising:

a paper substrate; and an inkjet-receptive coating comprising a primary pigment having a particle size distribution where at least 96% of the particles by weight have a particle size less than 2 microns, the primary pigment comprising aragonite;

a cationic secondary pigment having an average particle size of 3 microns or less;

calcium chloride;

a dispersant selected from the group consisting of dispersants containing polyether polycarboxylate salts, dispersants containing polyoxyalkylene salts and combinations thereof; and a binder wherein said binder is present in an amount from about 2 to 15 parts by weight of based on 100 parts total pigments.

* * * * *